US006897419B1

(12) United States Patent
Brown et al.

(10) Patent No.: US 6,897,419 B1
(45) Date of Patent: May 24, 2005

(54) SUSCEPTOR CONNECTION SYSTEM AND ASSOCIATED APPARATUS AND METHOD

(75) Inventors: Ronald W. Brown, Des Moines, WA (US); Larry D. Hefti, Auburn, WA (US); Marc R. Matsen, Seattle, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/817,285

(22) Filed: Apr. 2, 2004

(51) Int. Cl.[7] ..... H05B 6/22
(52) U.S. Cl. ..... 219/634; 219/659
(58) Field of Search ..... 219/633–635, 219/647, 659

(56) References Cited

U.S. PATENT DOCUMENTS

| | | | | |
|---|---|---|---|---|
| 4,173,611 | A | | 11/1979 | Benson et al. |
| 5,229,562 | A | | 7/1993 | Burnett et al. |
| 5,338,497 | A | | 8/1994 | Murray et al. |
| 5,410,133 | A | | 4/1995 | Matsen et al. |
| 5,420,400 | A | | 5/1995 | Matsen |
| 5,530,227 | A | | 6/1996 | Matsen et al. |
| 5,530,228 | A | | 6/1996 | Burnett et al. |
| 5,582,849 | A | | 12/1996 | Lupke |
| 5,591,369 | A | | 1/1997 | Matsen et al. |
| 5,591,370 | A | | 1/1997 | Matsen et al. |
| 5,645,744 | A | | 7/1997 | Matsen et al. |
| 5,645,747 | A | | 7/1997 | Matsen et al. |
| 5,658,403 | A | | 8/1997 | Kimura |
| 5,683,608 | A | | 11/1997 | Matsen et al. |
| 5,710,414 | A | | 1/1998 | Matsen et al. |
| 5,728,309 | A | | 3/1998 | Matsen et al. |
| 5,793,024 | A | * | 8/1998 | Matsen et al. ..... 219/633 |
| 5,808,281 | A | | 9/1998 | Matsen et al. |
| 6,180,932 | B1 | | 1/2001 | Matsen et al. |
| 6,528,771 | B1 | | 3/2003 | Matsen et al. |
| 6,653,608 | B1 | | 11/2003 | Matsen et al. |
| 6,747,253 | B1 | | 6/2004 | Firth et al. |
| 2003/0106890 | A1 | | 6/2003 | Matsen et al. |
| 2004/0256383 | A1 | * | 12/2004 | Fischer et al. ..... 219/634 |

* cited by examiner

*Primary Examiner*—Teresa J. Walberg
(74) *Attorney, Agent, or Firm*—Alston & Bird LLP

(57) ABSTRACT

A susceptor connection system and an associated apparatus and method are provided. The susceptor connection system includes at least one shoe that can be urged against a peripheral edge portion of the susceptors by a compression device. In this regard, each shoe can urge the edge portions of the susceptors together to achieve electrical contact therebetween, e.g., so that an induced current can flow between the susceptors to heat the susceptors and a workpiece. In addition, each shoe can define a passage for circulating a coolant to cool the edge portions and thereby reduce the oxidation and contact resistance between the susceptors.

28 Claims, 7 Drawing Sheets

SUSCEPTOR CONNECTION SYSTEM AND ASSOCIATED APPARATUS AND METHOD

BACKGROUND OF THE INVENTION

1) Field of the Invention

The present invention relates to the electrical connection of susceptors and, more particularly, to a system for releasably connecting susceptors and controlling the temperature of the susceptors, such as in an apparatus for heating and processing workpieces.

2) Description of Related Art

Induction heated susceptors are used for heating during various operations, such as in an apparatus for forming, joining, or otherwise processing composite or metallic members. For example, U.S. Pat. No. 6,180,932, titled "Brazing Honeycomb Panels with Controlled Net Tooling Pressure," describes a method of induction brazing honeycomb panels in a workcell using susceptor sheets that are heated to a brazing temperature. U.S. Pat. No. 5,530,227, titled "Method and Apparatus for Consolidating Organic Matrix Composites Using Induction Heating," and U.S. Pat. No. 5,420,400, titled "Combined Inductive Heating Cycle for Sequential Forming the Brazing," describe apparatuses and methods for forming workpieces of organic matrices and metals in which the workpiece is also heated by inducing a current in a susceptor. Generally, an electrical current can be induced in such a susceptor, and the current heats the susceptor until the susceptor reaches a Curie temperature. When a portion of the susceptor reaches the Curie temperature, that portion becomes paramagnetic and the current flows around that portion of the susceptor. Thus, the susceptor can heat the workpiece uniformly to a target temperature as required for forming, bonding, or otherwise processing the workpiece.

The susceptors can be provided as sheets that envelope the workpiece, i.e., first and second susceptor sheets can be disposed on opposite sides of the workpiece. The susceptor sheets are connected at a periphery so that the current induced in the susceptors can flow in a path through both of the susceptors and around the workpiece. For example, the peripheries of the susceptors can be welded together to achieve a satisfactory electrical contact therebetween. However, welding of the susceptor sheets generally increases the time and cost of the operation. Further, the welding or subsequent destruction of the weld joints (e.g., to remove the workpiece from between the susceptors) can damage the susceptors and prevent their re-use. Alternatively, as described in U.S. Pat. No. 6,180,932, the edges of the susceptors can be joined using crimps, gaskets, or a compression edge seal. Such non-weld joints can be formed relatively quickly and can be easily released so that the susceptor can be re-used. However, the contacting portions of the susceptors can oxidize or otherwise degrade during operation of the apparatus, thereby affecting the electrical contact resistance between the susceptors. In some cases, it may be necessary to regularly clean the contacting portions of the susceptors or replace the susceptors to ensure satisfactory electrical contact.

Thus, there exists a need for an improved susceptor connection system and an associated processing apparatus and method. The susceptor connection system should be easily connected and released and should reduce the occurrence of oxidation or other degradation of the contact portions of the susceptors. The connection system should be compatible with susceptors for different processing operations.

BRIEF SUMMARY OF THE INVENTION

The present invention provides a susceptor connection system and an associated apparatus and method. The connection system includes at least one shoe that can be urged against a peripheral edge portion of the susceptors by a compression device. Thus, the shoe places the edge portions of the susceptors in electrical contact. Further, each shoe can define a passage for circulating a coolant to cool the edge portions and thereby reduce the oxidation and contact resistance between the susceptors.

According to one embodiment of the present invention, the system includes first and second susceptors comprised of a conductive material for supporting an induced current flow and thereby heating to a target temperature. Each susceptor can be characterized by a Curie temperature at which the susceptor becomes paramagnetic, and an induction coil can be configured to generate an electromagnetic field and induce a current in the susceptors to heat the susceptors to the target temperature. At least one shoe is adapted to be urged against the peripheral edge portions of the susceptors to place the edge portions of the susceptors in electrical contact. Each shoe defines a passage for circulating a coolant, such as water, to cool the susceptors. A compression device such as a bladder is positioned adjacent the shoe or the peripheral edge portions of the susceptors. The compression device is configured to urge the shoe against the peripheral edge portions so that the susceptors are placed in electrical contact and the shoe thermally communicates with the peripheral edge portions to cool the peripheral edge portions.

The peripheral edge portion of each susceptor can be plated with a conductive material such as copper, and a central portion of each susceptor inward of the peripheral edge portion can be coated with a material comprising nickel-aluminum. According to one aspect of the invention, the peripheral edge portion of each susceptor defines a plurality of slots extending inward therethrough with tab portions therebetween.

The present invention also provides an apparatus for processing a workpiece at a target temperature. The apparatus includes first and second co-operable dies that are structured to define a die cavity therebetween for at least partially receiving the workpiece, and at least one of the dies defines a contour surface corresponding to a desired configuration of the workpiece. First and second susceptors are disposed in the die cavity. The susceptors are formed of a conductive material capable of supporting an induced current flow and thereby heating the workpiece to a target temperature, e.g., a forming temperature or bonding temperature of the workpiece. An induction coil extends around the susceptors and is configured to generate an electromagnetic field in the susceptors to induce a current in the susceptors and heat the susceptors to a Curie temperature at which the susceptors become paramagnetic. One or more shoes are adapted to be urged against the peripheral edge portions of the susceptors to place the edge portions of the susceptors in electrical contact. A compression device, such as a bladder positioned adjacent the shoe or the peripheral edge portions of the susceptors, is configured to urge the shoe against the peripheral edge portions so that the susceptors are placed in electrical contact and the shoe thermally communicates with the peripheral edge portions to cool the peripheral edge portions. Each shoe defines a passage for circulating a coolant such as water to cool the susceptors.

According to one method of the present invention for releasably connecting susceptors and controlling the temperature in the susceptors, peripheral edge portions of first and second conductive susceptors are urged together with one or more shoes to place the edge portions in electrical contact. For example, a pressurized fluid can be provided to a bladder to expand the bladder and urge together the shoe and the peripheral edge portions of the susceptors. A current is induced in the susceptors so that the susceptors are heated to a target temperature, e.g., to a Curie temperature of the susceptors at which the susceptors become paramagnetic. Coolant such as water is circulated through a passage defined by the shoe to thereby transfer thermal energy from the peripheral edge portions of the susceptors and control the temperature of the edge portions.

BRIEF DESCRIPTION OF THE SEVERAL VIEWS OF THE DRAWINGS

Figure 1:
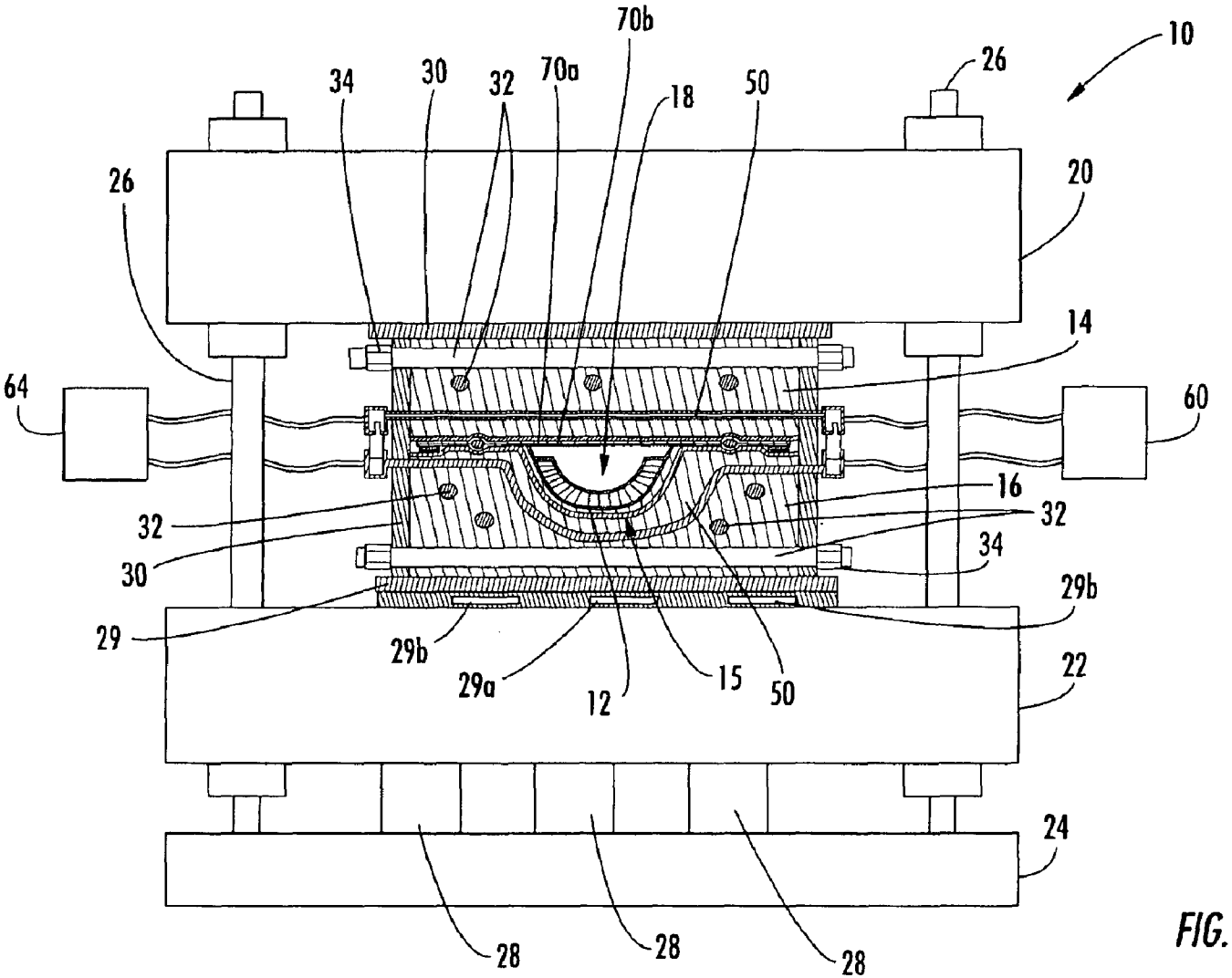
Figure 2:
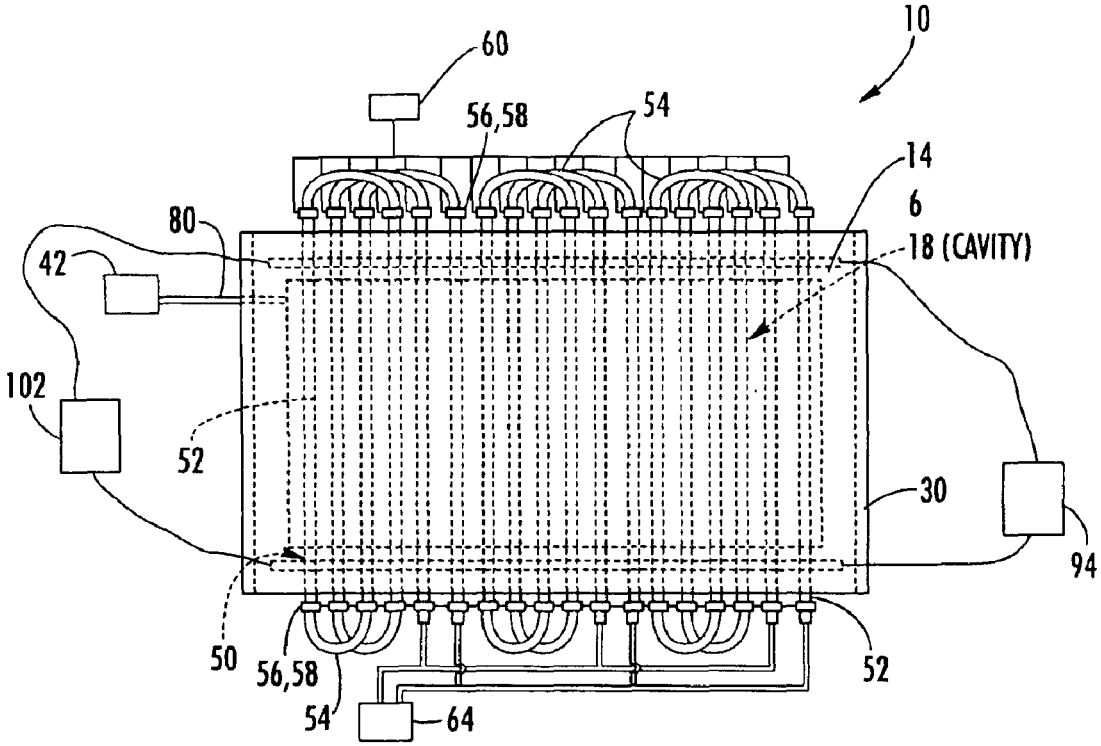
Figure 3:
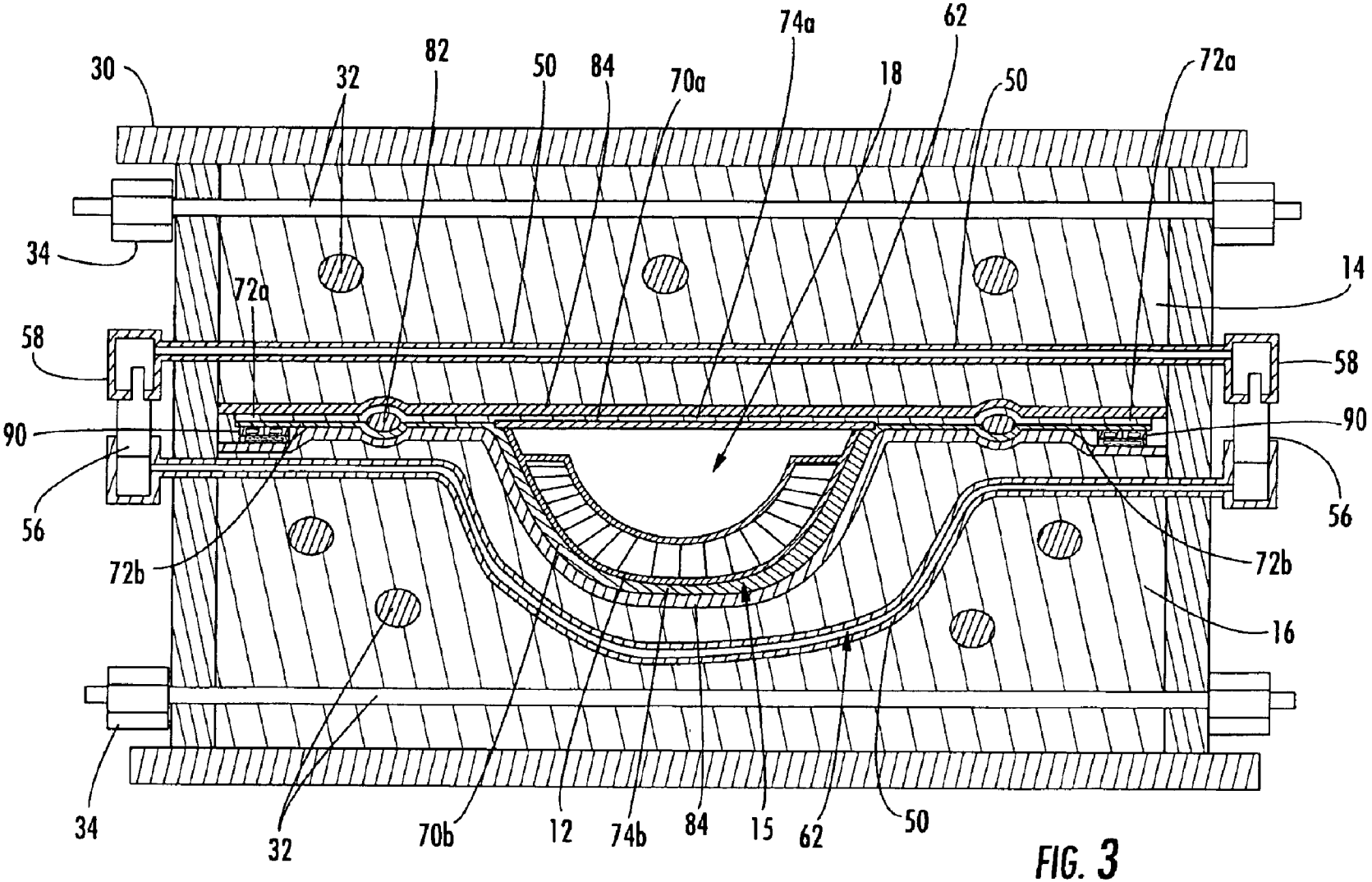
Figure 4:
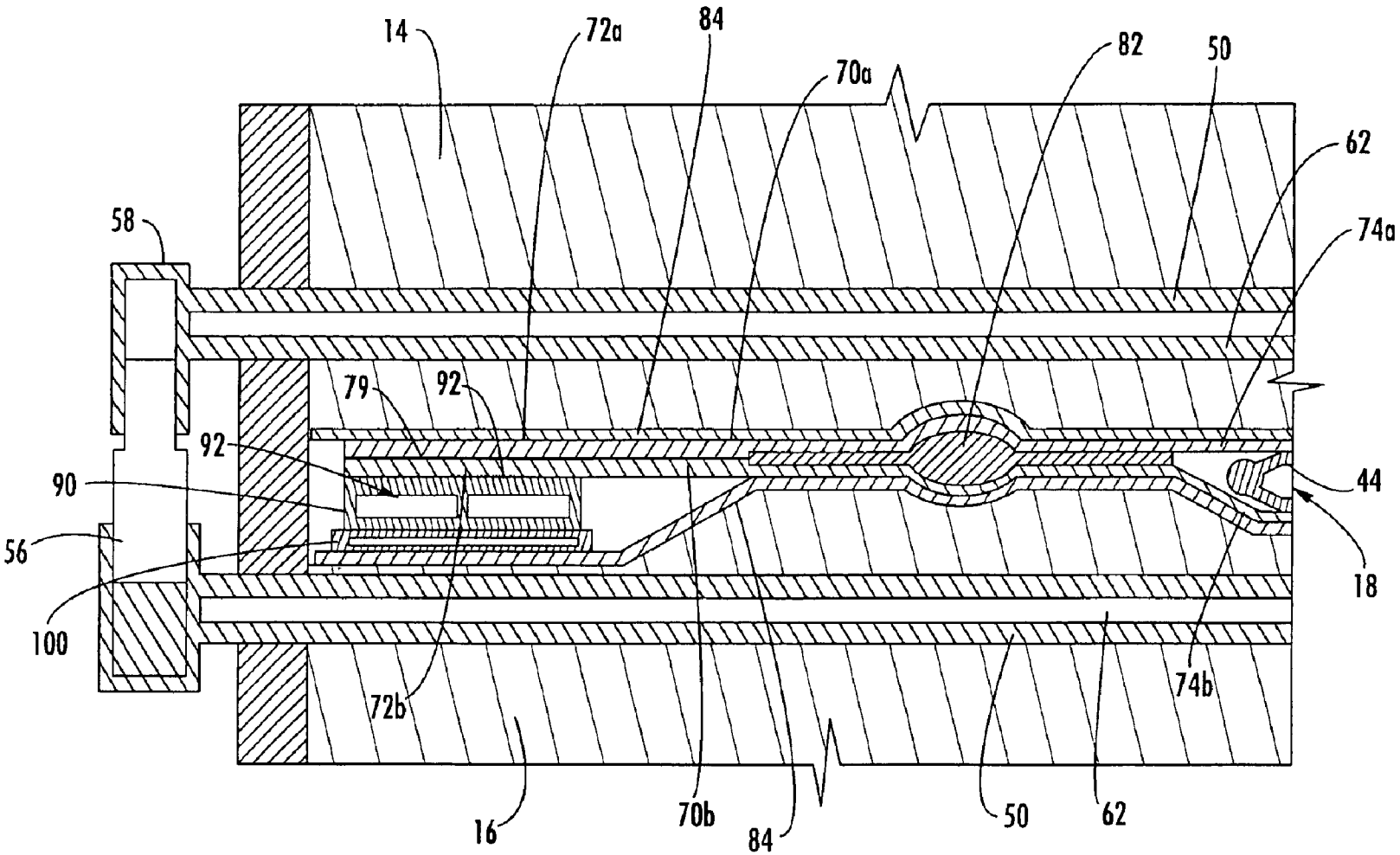
Figure 5:
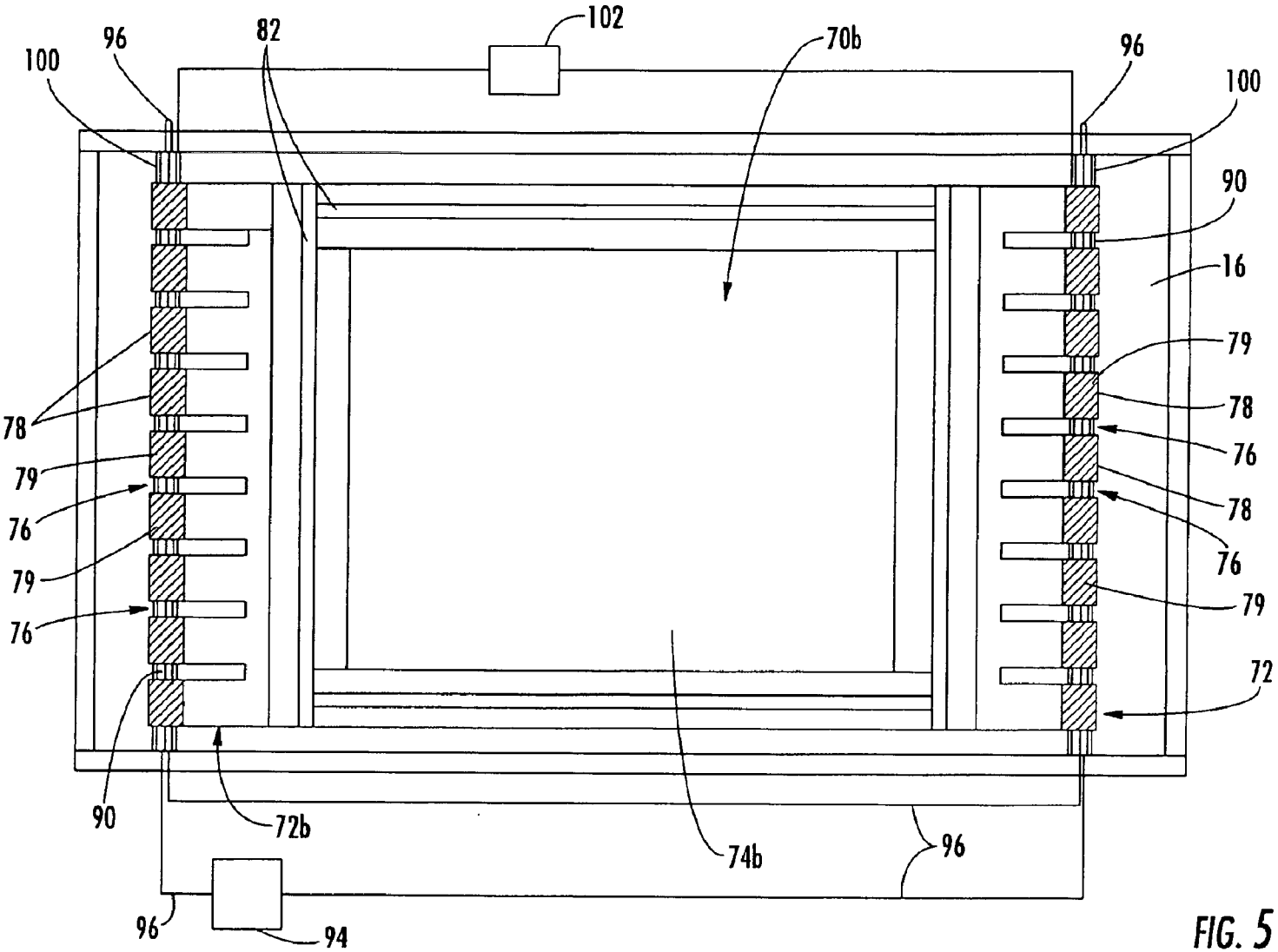
Figure 6:
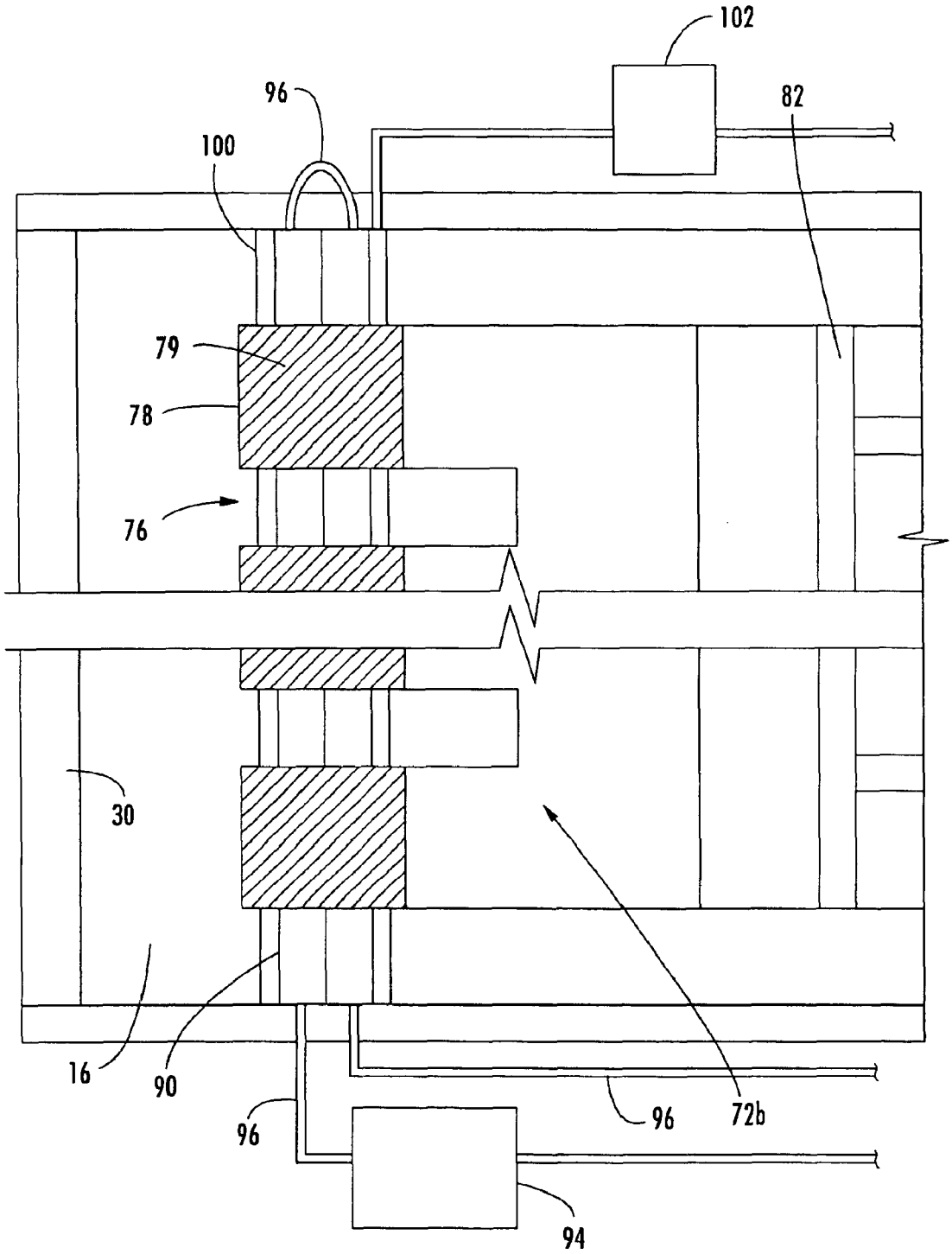

Having thus described the invention in general terms, reference will now be made to the accompanying drawings, which are not necessarily drawn to scale, and wherein:

FIG. 1 is a section view in elevation illustrating an apparatus for thermally processing a workpiece, according to one embodiment of the present invention;

FIG. 2 is a plan view illustrating the apparatus of FIG. 1;

FIG. 3 is an enlarged section view illustrating a portion of the apparatus of FIG. 1;

FIG. 4 is a further enlarged section view illustrating a portion of the connection system of the apparatus of FIG. 1;

FIG. 5 is a plan view illustrating a portion of the apparatus of FIG. 1, including one of the dies with part of the susceptor connection system;

FIG. 6 is an enlarged plan view illustrating a portion of FIG. 4; and

Figure 7:
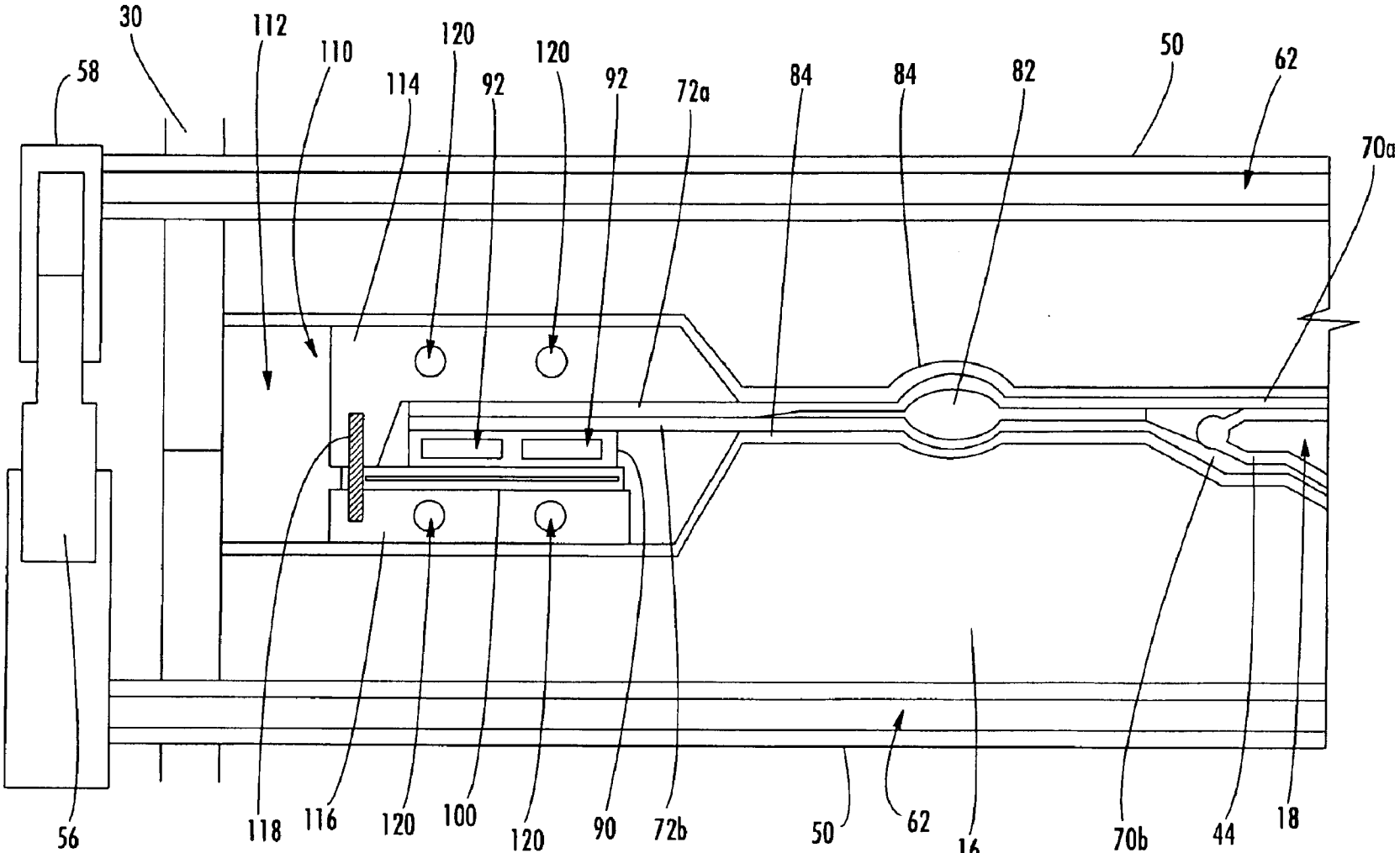

FIG. 7 is an enlarged section view illustrating a portion of a susceptor connection system in an apparatus according to another embodiment of the present invention.

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Referring now to the drawings, and in particular to FIGS. 1–4, there is illustrated an apparatus 10 for heating a workpiece 12 according to one embodiment of the present invention, e.g., to form, join, or otherwise process the workpiece 12. The term "workpiece" is not meant to be limiting, and it is understood that the workpiece 12 heated in the apparatus 10 can be simple or complex. The workpiece 12 can be one or more members formed of metallic or composite materials. For example, the workpiece 12 can include one or more flat sheets of material that are superplastically formed or otherwise formed to a desired shape and/or joined by diffusion bonding or other compressive bonding methods. In this regard, the apparatus 10 can include first and second opposed dies 14, 16 that are co-operable and configured to define a die cavity 18 therebetween that is structured to at least partially receive the workpiece 12. The die cavity 18 can define a contour according to which the workpiece 12 is formed, e.g., corresponding to the dimensions of a panel, spar, beam, or other structural member, which can be used in a variety of applications, for example, as a member of an aircraft wing, aircraft fuselage, other aeronautical vehicle, or the like. The workpiece 12 can also be fabricated for a wide variety of other applications including, without limitation, structural panels or other members for automotive or marine applications or the like.

As shown in FIG. 1, the first and second dies 14, 16 are generally mounted to and supported by first and second strongbacks 20, 22, respectively, which may be secured using a mechanical support structure comprising perpendicular members 26. A "strongback" is a stiff plate, such as a metal plate, that acts as a mechanical constraint to keep the first and second dies 14, 16 together and to maintain the dimensional accuracy of the dies 14, 16. As shown in FIG. 1, the second die 16 is connected to the second strongback 22, and the second strongback 22 in turn is connected to a base 24 via multiple actuators 28, such as hydraulic, pneumatic, or electric rams. The actuators 28 are configured to adjust the second strongback 22 and, hence, the second die 14 toward or away from the base 24, thereby opening or closing the die cavity 18. Other methods can also be used for configuring the dies 14, 16. For example, the first and/or second dies 14, 16 can be slidably adjustable on the perpendicular members 26, and either or both of the dies 14, 16 can be adjusted on the perpendicular members 26 to open the die cavity 18 using air bladders, hydraulic or pneumatic cylinders, mechanical jacks, levers, and the like. Air bladders or other adjustment devices can also be disposed between the dies 14, 16 and the strongbacks 20, 22. For example, as shown in FIG. 1, an intermediate bladder 29 is disposed between the second die 16 and the second strongback 22. The intermediate bladder 29 defines multiple inflatable portions that can be inflated independently, i.e., a central bladder portion 29*a* and a peripheral bladder portion 29*b* extending circumferentially around the central portion 29*a*. Thus, even if the second strongback 22 flexes slightly, the various portions of the bladder 29*a*, 29*b* can be inflated independently as necessary for maintaining the second die 16 in a planar configuration.

The first and second dies 14, 16 can be formed of a material characterized by a low thermal expansion, high thermal insulation, and a low electromagnetic absorption. For example, the dies 14, 16 can be formed of a material having a thermal expansion of less than about 0.45/(° F.×$10^6$) throughout a temperature range of between about 0° F. and 1850° F., a thermal conductivity of about 4 Btu/(hr)(ft)(° F.) or less, and substantially no electromagnetic absorption. According to one embodiment of the present invention, the dies 14, 16 are formed of cast ceramic, for example, using a castable fusible silica product such as Castable 120 available from Ceradyne Thermo Materials of Scottdale, Ga. Castable 120 has a coefficient of thermal expansion less than about 0.45/(° F.×$10^6$) for low expansion, a thermal conductivity of about 0.47 Btu/(hr)(ft)(° F.) to act as a heat insulator, and a low electromagnetic absorption coefficient.

The dies 14, 16 can be at least partially contained within an outer structure such as a box-like structure 30 formed of phenolic material. Further, the dies 14, 16 and phenolic box 30 can be reinforced with fibers and/or fiberglass reinforcing rods 32. The rods 32 can extend both longitudinally and transversely through the phenolic structure 30 and the first and second dies 14, 16, as illustrated in FIG. 1. To provide a post-stressed compressive state to the first and second dies 14, 16, the rods 32 can be placed through the phenolic structure 30 and secured within the first and second dies 14, 16 at the time of casting. Thereafter, nuts 34 at the ends of the rods 32 can be tightened to provide the post-stressed compressive state to prevent cracking or other damage to the dies 14, 16. The first and second dies 14, 16, the phenolic structure 30, and the reinforcement rods 32 are described in U.S. Pat. No. 5,683,608, entitled "Ceramic Die for Induction Heating Work Cells," which issued on Nov. 4, 1997, and which is assigned to the assignee of the present invention and the entirety of which is incorporated herein by reference.

The first and second dies 14, 16 can define one or more contoured surfaces within the die cavity 18 that correspond to a desired shape of the workpiece 12. For example, the dies can define a contoured surface 15 with a shape to which the workpiece 12 is to be formed during processing in the apparatus 10. Alternatively, the contoured surface 15 can correspond to the initial shape of the workpiece 12 so that the dies 14, 16 support the workpiece 12 in its shape during processing. Thus, during processing in the apparatus 10, the workpiece 12 can be heated, urged against the dies 14, 16, and cooled in the desired shape. The workpiece 12 can be urged against one or both of the dies 14, 16 by providing a pressurized fluid to the die cavity 18, e.g., from a source 42 of pressurized fluid that is fluidly connected to the cavity 18 by a pipe 80 (FIG. 2). In some embodiments of the present invention, the pressurized fluid can be provided by the source 42 to an inflatable bladder 44 or other structure. For example, an inflatable bladder is described in U.S. application Ser. No. 10/640,188, entitled "Forming Apparatus And Method," filed Aug. 13, 2003, and which is assigned to the assignee of the present invention and is incorporated herein by reference. In other embodiments of the present invention, the workpiece 12 can be heated in the apparatus 10 and processed without forming, e.g., to form bonds in the workpiece 12, to consolidate the material of the workpiece 12, to thermally treat the workpiece 12, and the like.

The workpiece 12 is heated to the target temperature for processing by an induction heater, i.e., an electromagnetic field generator, that induces a current in susceptors 70*a*, 70*b* that thermally communicate with the workpiece 12. The induction heater can be a plurality of induction coils 50, such as a solenoid coil as shown in FIGS. 1 and 2, for inducing an electric current in the susceptors 70*a*, 70*b*. Each induction coil 50 typically includes a plurality of elongate tube sections 52 that are interconnected by curved tube sections 54 to form coils that are positioned proximate to the die cavity 18 and the corresponding susceptors 70*a*, 70*b* in which the current is to be induced. For example, the elongate tube sections 52 can be formed of 1.0 inch diameter copper tubing with a 0.0625 inch wall thickness. The tube sections 52 can alternatively be formed of tubular sections of other sizes and/or with other cross-sectional shapes, for example, square or triangular tubes. The tube sections 52 are generally formed of an electrically conductive material such as copper. Lightly drawn copper tubing can be used so that the tube sections 52 can be adjusted as necessary to correspond to the configuration of the corresponding die 14, 16. The tube sections 52 can be positioned relatively close to, such as about 0.75 inches from, the susceptors 70*a*, 70*b*. The curved tube sections 54 are typically disposed outside the dies 14, 16.

Each curved tube section 54 can be formed of a flexible, non-conductive material such as plastic, and each tube section 52 can be disposed within only one of the two dies 14, 16 so that the tube sections 52, 54 form separate fluid paths in the first and second dies 14, 16, i.e., the curved tube sections 54 connect the tube sections 52 to other tube sections 52 that are in the same die 14, 16. The tube sections 52 of the two dies 14, 16 can also be electrically connected by pin and socket connectors 56, 58 as shown in FIG. 3, which can be disconnected when the dies 14, 16 are opened to expose the die cavity 18. The pin and socket connectors 56, 58 are preferably formed of a conductive material such as brass or copper. Thus, the pin and socket connectors 56, 58 maintain electrical conductivity between the tube sections 52 while the generally non-conductive curved sections 54 maintain fluid communication between the tube sections 52. Further, because the tube sections 52, 54 can form separate fluid paths in the first and second dies 14, 16, the dies 14, 16 can be opened without disconnecting the tube sections 52, 54. Therefore, the dies 14, 16 can be separated by disconnecting only the pin and socket connectors 56, 58, which can be quickly and easily connected and disconnected, thus simplifying the opening and closing of the die cavity 18.

The induction coil 50 is capable of being energized by one or more power supplies 60. The power supply 60 provides an alternating current to the induction coil 50, e.g., between about 3 and 10 kHz. This alternating current through the induction coil 50 induces a secondary current within the susceptors 70*a*, 70*b* that heats the susceptors 70*a*, 70*b* and, thus, the workpiece 12. The temperature of the susceptors 70*a*, 70*b* and the workpiece 12 can be inferred by monitoring electrical parameters within the one or more power supplies 60, as described in U.S. application Ser. No. 10/094,494, entitled "Induction Heating Process Control," filed Mar. 8, 2002, and which is assigned to the assignee of the present invention and is incorporated herein by reference. The use of susceptors for brazing, consolidating, and forming operations is also described in U.S. Pat. Nos. 6,180,932; 5,530,227; and 5,420,400, each of which is assigned to the assignee of the present invention and is incorporated herein in its entirety by reference.

Due to the low electromagnetic absorption of the dies 14, 16, the induction coil 50 induces a current within the susceptors 70*a*, 70*b* without inducing an appreciable current in the dies 14, 16. Therefore, the susceptors 70*a*, 70*b* can be heated to high temperatures without heating the dies 14, 16, thereby saving energy and time during heating and cooling of the workpiece 12. Further, due to the low thermal expansion of the dies 14, 16, the induction coil 50 can be kept relatively cool while the susceptors 70*a*, 70*b* heat the workpiece 12 without inducing stresses in the dies 14, 16 sufficient to cause spalling or otherwise degrading the dies 14, 16. Additionally, the low thermal conductivity of the ceramic dies 14, 16 reduces heat loss from the die cavity 18 and, thus, the workpiece 12.

The induction coil 50 can define a passage 62 for circulating a cooling fluid, such as water, from a fluid source 64, as shown in FIG. 1. A pump circulates the cooling fluid from the fluid source 64 through the passage 62. The cooling fluid cools the induction coil 50 to maintain low electrical resistivity in the coil 50. In addition, by positioning the induction coil 50 uniformly relative to the susceptors 70*a*, 70*b*, the induction coil 50 can be used to heat the susceptors 70*a*, 70*b* uniformly, and the cooling fluid can be used to transfer thermal energy from the susceptors 70*a*, 70*b* to cool the susceptors 70*a*, 70*b*. Thus, the cooling fluid can be used to cool the workpiece 12 after the workpiece 12 has been thermally processed.

The susceptors 70*a*, 70*b* are formed of a material that is characterized by a Curie temperature at which the susceptors 70*a*, 70*b* become paramagnetic, for example, a ferromagnetic alloy such as an alloy comprising iron and nickel.

Susceptors having Curie temperatures at which each susceptor becomes nonmagnetic, or paramagnetic, are described in U.S. Pat. No. 5,728,309, entitled "Method for Achieving Thermal Uniformity in Induction Processing of Organic Matrix Composites or Metals," which issued on Mar. 17, 1998; U.S. Pat. No. 5,645,744, entitled "Retort for Achieving Thermal Uniformity in Induction Processing of Organic Matrix Composites or Metals," which issued on Jul. 8, 1997; and U.S. Pat. No. 5,808,281, entitled "Multilayer Susceptors for Achieving Thermal Uniformity in Induction Processing of Organic Matrix Composites or Metals," which issued on Sep. 15, 1998, each of which is assigned to the assignee of the present invention and is incorporated herein by reference.

The susceptors 70*a*, 70*b* can be provided as separate first and second portions 70*a*, 70*b* on the first and second dies 14, 16 so that when the dies 14, 16 are opened the susceptors 70*a*, 70*b* are also opened and the workpiece 12 and/or bladder 44 can be inserted or removed from the die cavity 18. For example, the susceptors 70*a*, 70*b* can be cast within either or both of the first and second dies 14, 16 or otherwise disposed thereon. Alternatively, the individual susceptors 70*a*, 70*b* can be connected to the respective dies 14, 16 by studs, rivets, or other connectors such as screws, bolts, clips, weld joints, and the like. In any case, the susceptors 70*a*, 70*b* can be configured on the dies 14, 16 such that peripheral edge portions 72*a*, 72*b* of the susceptors 70*a*, 70*b* make electrical contact when the dies 14, 16 are closed. Further, the apparatus 10 can include one or more shoes 90 for urging the longitudinally opposite edge portions 72*a*, 72*b* of the susceptors 70*a*, 70*b* together. Each shoe 90 can be formed of one or more elongate members, each of which defines a passage 92 through which a coolant can be circulated during operation of the apparatus 10. For example, as illustrated in FIGS. 4–6, each shoe 90 can be formed of two parallel copper tubes that are rectangular in cross-section and relatively thick-walled. The passages 92 extending through each of the tubes are connected to a coolant source 94. In particular, the passages 92 are connected in a series configuration by connection tubes 96 to the coolant source 94 in FIG. 4, though various other configurations can also be used, including a configuration in which each of the passages 92 of the shoes 90 is connected in parallel to the source 94.

A compression device can also be positioned adjacent to each shoe 90 and configured to urge the respective shoe 90 against the peripheral edge portions 72*a*, 72*b* of the susceptors 70*a*, 70*b* to electrically engage the edge portions 72*a*, 72*b*. For example, the compression device can be an inflatable bladder 100 that is fluidly connected to a source 102 (FIG. 5) of pressurized fluid so that the bladder 100 can be inflated by the source 102 to compress the edge portions 72*a*, 72*b* between the shoe 90 and one of the dies 14, 16. The inflatable bladders 100 can be formed of metal such as 300 series austenitic stainless steel, and the source 102 can be a compressor or pressure vessel that is configured to provide compressed air or other gas to the bladders 100. Thus, when the dies 14, 16 are closed, the bladder 100 at the left side of the apparatus 10 (as shown in FIGS. 3 and 5) is disposed between the shoe 90 and the second die 16, and the bladder 100 at the right side of the apparatus 10 is disposed between the shoe 90 and the second die 16. As the bladders 100 are inflated, the shoes 90 urge the peripheral portions 72*a*, 72*b* of the susceptors 70*a*, 70*b* against the first die 14 and compress the portions 72*a*, 72*b* together to achieve a satisfactory electrical connection therebetween.

The susceptors 70*a*, 70*b* are heated through eddy current heating to the Curie temperature of the susceptors 70*a*, 70*b*, whereupon the susceptors 70*a*, 70*b* become paramagnetic and do not rise appreciably further in temperature. Eddy current heating of the susceptors 70*a*, 70*b* results from eddy currents that are induced in the susceptors 70*a*, 70*b* by the electromagnetic field generated by the induction coil 50. The flow of the eddy currents through the susceptors 70*a*, 70*b* results in resistive heating of the susceptors 70*a*, 70*b*. If some portions of the susceptors 70*a*, 70*b* are heated more quickly than other portions, the hotter portions will reach the Curie temperature and become paramagnetic before the other, cooler portions of the susceptors 70*a*, 70*b*. The magnetic flux lines will then flow through the cooler magnetic portions, i.e., around the hotter, paramagnetic portions of the susceptors 70*a*, 70*b*. The current in the susceptors 70*a*, 70*b*, which flows substantially perpendicular to the magnetic flux but is proportional to the magnetic flux density, causes the cooler portions to also become heated to the Curie temperature. Therefore, even if some portions of the susceptors 70*a*, 70*b* heat at different rates, the entire susceptors 70*a*, 70*b* are heated to a uniform Curie temperature. Further, the susceptors 70*a*, 70*b* can act as a magnetic shield that prevents the induction coil 50 from inducing a current in the workpiece 12. As such, the induction coil 50 does not heat the structural workpiece 12 directly, but rather heats the susceptors 70*a*, 70*b*, which, in turn, act as a heat source in thermal communication with the workpiece 12.

The Curie temperature of the susceptors 70*a*, 70*b* can correspond to the target temperature of the workpiece 12, e.g., a forming temperature at which the workpiece 12 can be formed and/or a bonding temperature at which the workpiece 12 can be bonded. For example, the Curie temperature of the susceptors 70*a*, 70*b* can be equal to or slightly greater than the target temperature of the workpiece 12 so that the workpiece 12 is heated to the target temperature when the susceptors 70*a*, 70*b* are heated to the Curie temperature. Thus, the susceptors 70*a*, 70*b* can be used to heat the workpiece 12 uniformly to the target temperature so that the workpiece 12 can be formed, bonded, or otherwise processed.

The susceptors 70*a*, 70*b* can be formed of a variety of materials including iron, nickel, cobalt, and alloys thereof, and the composition of the susceptors 70*a*, 70*b* an be designed to have a Curie temperature for achieving a desired target temperature that is appropriate for a particular type of processing of a workpiece formed of a particular type of material. For example, susceptors 70*a*, 70*b* with a Curie temperature of about 750° F. can be used for forming a composite workpiece of Ultem® resin. In one embodiment, the susceptors 70*a*, 70*b* are formed of an alloy that typically includes approximately 53% iron, 29% nickel, 17% cobalt, and 0.2% chromium, generally referred to as Kovar®, a registered trademark of CRS Holdings, Inc. This alloy has a Curie temperature of about 750° F. In any case, the susceptors 70*a*, 70*b* can be removable from the dies 14, 16 and can be replaced if they become worn or if it is desired to install susceptors 70*a*, 70*b* with a different Curie temperature. Thus, the apparatus 10 can be used for processing workpieces 12 formed of a variety of materials or in a variety of processing operations.

Due to the electrical contact between the susceptors 70*a*, 70*b*, eddy currents induced in the susceptors 70*a*, 70*b* by the induction coils 50 can flow throughout the susceptors 70*a*, 70*b*, and, in particular, between the susceptors 70*a*, 70*b* through the peripheral portions 72*a*, 72*b* in contact by virtue of the shoes 90 and the compression devices 100. Each shoe 90 thermally communicates with the peripheral edge portions 72*a*, 72*b* to cool the peripheral edge portions 72*a*, 72*b*.

In this regard, the shoes 90 transfer thermal energy from the peripheral edge portions 72*a*, 72*b* of the susceptors 70*a*, 70*b* to the coolant circulated through the shoes 90, thereby cooling the edge portions 72*a*, 72*b*. The temperature of the edge portions 72*a*, 72*b* of the susceptors 70*a*, 70*b* can be controlled by adjusting the temperature and flow rate of the coolant.

For example, the coolant can be water that is circulated to the shoes 90 at room temperature, and the coolant can be circulated at a sufficient rate to cool the edge portions 72*a*, 72*b* of the susceptors 70*a*, 70*b* to a temperature of about 100° F. or less. Thus, the peripheral edge portions 72*a*, 72*b* of the susceptors 70*a*, 70*b* can be maintained at a relatively low temperature, even while a central portion 74*a*, 74*b* of each susceptor 70*a*, 70*b* inward of the peripheral edge portions 72*a*, 72*b* is heated by the induced current to the target processing temperature.

Each of the susceptors 70*a*, 70*b* can also define slots 76 extending inward through the peripheral edge portions 72*a*, 72*b* and tab portions 78 of the susceptors 70*a*, 70*b* between the slots 76. The slots 76 can reduce the stress in the susceptors 70*a*, 70*b* that might otherwise result due to the thermal gradients existing between the heated inward central portion 74*a*, 74*b* of the susceptors 70*a*, 70*b* and the cooled peripheral portions 72*a*, 72*b*. At least part of the tabs 78 can be plated with a conductive material such as copper to facilitate the electrical connection between the susceptor sheets 70*a*, 70*b*. For example, the opposed surfaces 79 of the tabs 78 can be plated with copper as shown in FIGS. 4–6. The remainder of the susceptor sheets 70*a*, 70*b*, including the central portion 74*a*, 74*b* of each susceptor 70*a*, 70*b*, can have an oxidation resistant coating, such as a nickel aluminide coating that is flame-sprayed or otherwise disposed on the surface of the susceptors 70*a*, 70*b*. A description of a susceptor with a nickel aluminide coating is provided in U.S. application Ser. No. 10/032,625, entitled "Smart Susceptors with Oxidation Control," filed Oct. 24, 2001, and which is assigned to the assignee of the present invention and is incorporated herein by reference.

As shown in FIGS. 4 and 5, the apparatus 10 can also include a cavity seal 82 that is disposed between the dies 14, 16, for example, between the susceptors 70*a*, 70*b* at a location between the die cavity 18 and the peripheral edge portions 72*a*, 72*b*. The cavity seal 82 can be a ridge-like structure that extends continuously around the die cavity 18 and hermetically seals the die cavity 18 during operation to prevent pressurized gas in the cavity 18 from leaking. The cavity seal 82 can also be formed of a nonconductive material so that the induced current flowing between the two susceptors 70*a*, 70*b* flows through the peripheral edge portions 72*a*, 72*b* rather than through the cavity seal 82. For example, for applications in which the target temperature of the apparatus 10 is below 550° F., the cavity seal 82 can be formed of silicon based elastomeric materials. For applications in which the target temperature is above 550° F., the seal 82 can be formed of a composite material such as $Al_2O_3$ fibers disposed in a matrix of $Al_2O_3$, SiC fibers disposed in a matrix of SiC, or other dielectric materials. In addition, a liner 84 or other barrier material can be provided between each die 14, 16 and the adjacent susceptor 70*a*, 70*b*. The liner 84 can be formed of dielectric and/or composite materials similar to those used for the seal 82. Die liners are further discussed in U.S. Patent Application Publication No. 2003/0106890, titled "Induction Processable Ceramic Die with Durable Die Liner," which was published Jun. 12, 2003 and is assigned to the assignee of the present invention, and the entirety of which is incorporated herein by reference.

One or more pipes 80, tubes, or other fluid communication devices can extend through the cavity seal 82, through one of the susceptors 70*a*, 70*b*, or between the cavity seal 82 and one of the susceptors 70*a*, 70*b* as shown in FIG. 2. For example, the pipe 80 fluidly connects the die cavity 18 with the pressurized fluid source 42, so that the fluid source 42 can supply fluid to the die cavity 18 while the cavity 18 is sealed by the cavity seal 82 during processing. Additional pipes can also be provided for evacuating the cavity 18.

During operation according to one embodiment of the present invention, the workpiece 12 is a blank, which can be cut to a predetermined shape that corresponds to the desired dimensions of a structural member to be formed. The workpiece 12 is disposed in the die cavity 18, and one or both of the dies 14, 16 are adjusted to close the die cavity 18. The die cavity 18 is hermetically sealed by the cavity seal 82. The pin and socket connectors 56, 58 can be configured to engage as the die cavity 18 is closed so that the induction coil 50 forms a circuit extending around the workpiece 12. The susceptors 70*a*, 70*b* are also electrically engaged, by urging the dies 14, 16 together and inflating the bladders 100 to urge the shoes 90 against the susceptors 70*a*, 70*b*, thereby compressing the longitudinally opposite peripheral portions 72*a*, 72*b* of the two susceptors 70*a*, 70*b* between the shoes 90 and the first die 14. It is appreciated that the compression devices 100 and the shoes 90 can be configured to urge the susceptors 70*a*, 70*b* against either of the dies 14, 16, or each compression device 10 can be disposed opposite the susceptors 70*a*, 70*b* from the respective shoe 90 so that the susceptors 70*a*, 70*b* are compressed between each compression device 100 and the respective shoe 90. In any case, the peripheral edge portions 72*a*, 72*b* of the susceptors 70*a*, 70*b* are urged together to thereby electrically engage the susceptors 70*a*, 70*b* and so that the shoes 90 can thermally communicate with the susceptors 70*a*, 70*b* to control the temperature of the peripheral portions 72*a*, 72*b*.

The workpiece 12 is then heated, for example, by energizing the power supply 60 so that the induction coil 50 provides an electromagnetic field that induces a current in the susceptors 70*a*, 70*b*. The susceptors 70*a*, 70*b* can be heated to a Curie temperature that corresponds to the forming temperature of the workpiece 12, for example, about 750° F., within about 15 to 30 seconds, though shorter and longer heating cycles are possible. Before, during, or after the heating of the workpiece 12, the pressurized fluid can be provided to the die cavity 18 from the pressurized fluid source 42, e.g., to form the workpiece 12 against the contoured surface 15 or to form bonds in the workpiece 12. While the central portions 74*a*, 74*b* of the susceptors 70*a*, 70*b* are heated to the target temperature, the temperature of the peripheral edge portions 72*a*, 72*b* is controlled by circulating the coolant through the shoes 90. For example, water can be circulated from the coolant source 94, through the shoes 90, and discharged from the shoes 90. The water can be cooled and recirculated or discarded after use. In any case, the temperature of the peripheral edge portions 72*a*, 72*b* can be maintained below a maximum temperature, e.g., of about 100° F. By reducing the operating temperature of the contacting peripheral edge portions 72*a*, 72*b* of the susceptors 70*a*, 70*b*, oxidation of the susceptors 70*a*, 70*b* and contact resistance between the contacting opposed portions 79 of the two susceptors 70*a*, 70*b* can be minimized.

After the workpiece 12 is formed against the contoured surface 15, the pressure in the bladder 44 can be maintained while the workpiece 12 cools. For example, the workpiece 12 can be cooled in the apparatus 10 to below a plasticizing temperature so that the workpiece 12 can be removed from the die cavity 18 without substantially plastically deforming the workpiece 12 from its shape. A coolant fluid such as the pressurized fluid from the source 42 can be circulated through the die cavity 18 while the cavity is pressurized to cool the workpiece 12.

In addition, heat treatments can be performed on the workpiece 12 while the workpiece 12 is in the die cavity 18. For example, the workpiece 12 can be heated and cooled according to a predetermined schedule. Such heat treatment are discussed in U.S. application Ser. No. 10/431,295, entitled "Method and Apparatus for Induction Heat Treatment of Structural Members," filed May 7, 2003, and which is assigned to the assignee of the present invention and is incorporated herein by reference.

FIG. 7 illustrates another embodiment of the present invention that includes a clamping device 110 disposed between the dies 14, 16. Generally, the clamping device 110 can be used in conjunction with the shoes 90 and the bladder 100 to electrically engage the susceptors 70*a*, 70*b* while allowing the peripheral edge portions 72*a*, 72*b* of the susceptors 70*a*, 70*b* to adjust as the susceptors change size as a result of changes in temperature. In this regard, stresses in the susceptors 70*a*, 70*b* can be reduced during processing. In particular, the clamping device 110 is received in a space 112 between the dies 14, 16 at one of the longitudinal ends of the susceptors 70*a*, 70*b*. It is appreciated that another clamping device can also be provided at the longitudinally opposite ends of the susceptors 70*a*, 70*b*. As illustrated, the clamping device 110 is c-shaped with first and second arm members 14, 116. The arm members 114, 116 are releasably attached by a pin 118 or other releasable connection device. With the pin 118 released, the arms 114, 116 can be separated, e.g., so that the first and second arms 114, 116 can remain in contact with the respective dies 14, 16 as the dies 14, 16 are opened. With the pin 118 engaged, the arms 114, 116 are secured together so that the peripheral edge portions 72*a*, 72*b* of the susceptors 70*a*, 70*b*, the shoe 90, and the bladder 100 are constrained therebetween. In fact, as the bladder 100 is inflated, the clamping device 110 resists the expanding action of the bladder 100 so that the susceptors 70*a*, 70*b* are squeezed between the shoe 90 and the first arm member 114. The clamping device 110 can be smaller than the space 112 between the dies 14, 16 and each arm 114, 116 can be adjustable relative to the dies 14, 16 so that the peripheral edge portions 72*a*, 72*b* of the susceptors 70*a*, 70*b* and the clamping device 110 can move as the susceptors 70*a*, 70*b* expand or contract during thermal processing.

Each of the arm members 114, 116 of the clamping device 110 can be formed of a heat resistant material such as 300 series stainless steel. Further, the arms 114, 116 can define passages 120 through which a coolant fluid can be received. For example, the passages 120 can be configured to receive a flow of the coolant from the coolant source 94. Thus, the clamping device 110 can be configured to remove thermal energy from the peripheral edge portions 72*a*, 72*b* of the susceptors 70*a*, 70*b*, thereby controlling the temperature of the susceptors 70*a*, 70*b* in conjunction with the shoes 90.

During one typical operation of the embodiment of FIG. 7, the workpiece 12 and susceptors 70*a*, 70*b* are disposed in the die cavity 18, with the peripheral edge portions 72*a*, 72*b* of the susceptors 70*a*, 70*b* between the arms 114, 116 of the clamping device 110, which can be separated with the dies 14, 16. The arms 114, 116 of the clamping device 110 are aligned, e.g., automatically with springs or actuators, so that the pin 118, which can be disposed in one of the arm members 114, 116, is aligned with a hole or device in the opposite arm member 114, 116 for engaging the pin 118. The dies 14, 16 are then closed, and the pin 118 engages the arms 114, 116 so that the arms 114, 116 are secured together with the susceptors 70*a*, 70*b* therebetween as shown in FIG. 7. In some cases, the engagement of the pin 118 can be triggered automatically, e.g., by an expanding force on the arms 114, 116 provided by a partial inflation of the bladder 110. In any case, with the clamping device 110 clamping the peripheral edge portions 70*a*, 70*b* together and the bladder 110 inflated, the susceptor sheets 70*a*, 70*b* are squeezed between the shoe 90 and the first arm 114. The dies 14, 16 can then be opened slightly, and the susceptors 70*a*, 70*b* at least partially heated so that the susceptors 70*a*, 70*b* thermally expand, with the peripheral edge portions 72*a*, 72*b* and, hence, the clamping device 110, moving outward from the die cavity 118 accordingly. Once the susceptors 70*a*, 70*b* have reached an expanded configuration, the die cavity 18 can be closed again, and the thermal processing operation can be performed.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A susceptor connection system for releasably connecting susceptors, the system comprising:

first and second susceptors comprised of a conductive material for supporting an induced current flow and thereby heating to a target temperature, each susceptor defining a peripheral edge portion;

at least one shoe adapted to be urged against the peripheral edge portions of the susceptors to place the edge portions of the susceptors in electrical contact, each shoe defining a passage for circulating a coolant to cool the susceptors; and a compression device positioned adjacent at least one of the shoe and the peripheral edge portions of the susceptors, the compression device being configured to urge the shoe against the peripheral edge portions such that the susceptors are placed in electrical contact and the shoe thermally communicates with the peripheral edge portions to cool the peripheral edge portions.

2. A system according to claim 1 further comprising a water source configured to deliver a flow of water to the shoe, the water being cooler than the target temperature of the susceptors.

3. A system according to claim 1 wherein each susceptor is characterized by a Curie temperature at which the susceptor becomes paramagnetic.

4. A system according to claim 1 further comprising an induction coil extending around the susceptors, the induction coil being configured to generate an electromagnetic field to induce a current in the susceptors and heat the susceptors to the target temperature.

5. A system according to claim 1 wherein the compression device comprises a bladder configured to be expanded by a pressurized fluid to urge the shoe and the susceptors together.

6. A system according to claim 1 wherein the peripheral edge portion of each susceptor defines a plurality of slots extending inward through the peripheral edge portions of the susceptors and thereby defining tab portions therebetween.

7. A system according to claim 1 wherein opposed surfaces of the peripheral edge portions of the susceptors are coated with a conductive material.

8. A system according to claim 7 wherein the opposed surfaces of the peripheral edge portions are plated with copper.

9. A system according to claim 1 wherein a central portion of each susceptor inward of the peripheral edge portion is coated with a material comprising nickel-aluminum.

10. A system according to claim 1 further comprising at least one clamping device configured to constrain the peripheral edge portions of the dies in electrical contact, the clamping device being configured to be adjusted as the susceptors change dimensionally.

11. An apparatus for processing a workpiece at a target temperature, the apparatus comprising:

first and second co-operable dies structured to define a die cavity therebetween for at least partially receiving the workpiece, at least one of the dies defining a contour surface corresponding to a desired configuration of the workpiece;

first and second susceptors disposed in the die cavity, the susceptors comprised of a conductive material for supporting an induced current flow and thereby heating the workpiece to a forming temperature, each susceptor defining first and second longitudinally opposite peripheral edge portions;

first and second shoes adapted to be urged against the first and second peripheral edge portions of the susceptors respectively to place the respective peripheral edge portions of the susceptors in electrical contact, each shoe defining a passage for circulating a coolant to cool the susceptors; and at least one compression device positioned adjacent at least one of each shoe and the respective peripheral edge portions of the susceptors, the compression device being configured to urge the shoes against the respective peripheral edge portions such that the susceptors are placed in electrical contact and the shoes thermally communicate with the peripheral edge portions to cool the peripheral edge portions.

12. An apparatus according to claim 11 wherein a Curie temperature of each susceptor is about equal to the forming temperature of the workpiece.

13. An apparatus according to claim 11 further comprising a water source configured to deliver a flow of water to each shoe, the water being cooler than the target temperature of the susceptors.

14. An apparatus according to claim 11 wherein each susceptor is characterized by a Curie temperature at which the susceptor becomes paramagnetic.

15. An apparatus according to claim 11 further comprising an induction coil extending around the susceptors, the induction coil being configured to generate an electromagnetic field to induce a current in the susceptors and heat the susceptors to a Curie temperature.

16. An apparatus according to claim 11 wherein each compression device comprises a bladder configured to be expanded by a pressurized fluid to urge a respective one of the shoes against a respective one of the susceptors.

17. An apparatus according to claim 11 wherein each peripheral edge portion of the susceptors defines a plurality of slots extending inward through the peripheral edge portions of the susceptors and thereby defining tab portions therebetween.

18. An apparatus according to claim 11 wherein opposed surfaces of the peripheral edge portions of the susceptors are coated with a conductive material.

19. An apparatus according to claim 11 wherein opposed surfaces of the peripheral edge portions of the susceptors are plated with copper.

20. An apparatus according to claim 11 wherein a central portion of each susceptor between the peripheral edge portions is coated with a material comprising nickel-aluminum.

21. An apparatus according to claim 11 further comprising at least one clamping device configured to constrain the peripheral edge portions of the dies in electrical contact, the clamping device being adjustable relative to the dies.

22. A method for releasably connecting susceptors and controlling the temperature in the susceptors, the method comprising:

providing first and second conductive susceptors;

urging peripheral edge portions of the susceptors together with at least one shoe to place the edge portions of the susceptors in electrical contact;

inducing a current in the susceptors and thereby heating the susceptors to a target temperature; and circulating coolant through a passage defined by the shoe and thereby transferring thermal energy from the peripheral edge portions of the susceptors and controlling the temperature of the peripheral edge portions.

23. A method according to claim 22 wherein said circulating step comprises delivering a flow of water from a water source through the shoe, the water being cooler than the peripheral edge portions of the susceptors.

24. A method according to claim 22 wherein said inducing step comprises heating a portion of the susceptors to a Curie temperature at which the susceptors become paramagnetic.

25. A method according to claim 22 wherein said inducing step comprises generating an electromagnetic field with an induction coil extending around the susceptors.

26. A method according to claim 22 wherein said urging step comprises providing a pressurized fluid to a bladder to expand the bladder and urge together the shoe and the peripheral edge portions of the susceptors, thereby electrically engaging the peripheral edge portions of the susceptors.

27. A method according to claim 22 wherein said inducing step comprises heating each susceptor to a Curie temperature at which the susceptor becomes paramagnetic.

28. A method according to claim 22 further comprising clamping the peripheral edge portions of the dies in electrical contact with a clamping device that is configured to adjust relative to the dies as the susceptors change dimensionally.

* * * * *